United States Patent [19]

Sagawa

[11] Patent Number: 5,000,800

[45] Date of Patent: Mar. 19, 1991

[54] PERMANENT MAGNET AND METHOD FOR PRODUCING THE SAME

[75] Inventor: Masato Sagawa, 12-17 Jige-cho, Matsumuro, Nishikyo-ku, Kyoto-shi, Japan

[73] Assignee: Masato Sagawa, Japan

[21] Appl. No.: 321,183

[22] Filed: Mar. 9, 1989

[30] Foreign Application Priority Data

| | | | |
|---|---|---|---|
| Jun. 3, 1988 | [JP] | Japan | 63-135419 |
| Jul. 15, 1988 | [JP] | Japan | 63-175087 |
| Oct. 6, 1988 | [JP] | Japan | 63-250850 |
| Dec. 26, 1988 | [JP] | Japan | 63-326225 |

[51] Int. Cl.[5] ..... H01F 1/053

[52] U.S. Cl. ..... 148/302; 420/83

[58] Field of Search ..... 143/302; 420/83

[56] References Cited

U.S. PATENT DOCUMENTS

| | | | |
|---|---|---|---|
| 4,601,875 | 7/1986 | Yamamoto et al. | 419/23 |
| 4,684,406 | 8/1987 | Matsuura et al. | 148/302 |
| 4,767,474 | 8/1988 | Fujimura et al. | 148/302 |
| 4,770,723 | 9/1988 | Sagawa et al. | 148/302 |
| 4,773,950 | 9/1988 | Fujimura et al. | 148/302 |
| 4,792,368 | 12/1988 | Sagawa et al. | 148/302 |

FOREIGN PATENT DOCUMENTS

| | | | |
|---|---|---|---|
| 106948 | 5/1984 | European Pat. Off. | 148/302 |
| 134305 | 3/1985 | European Pat. Off. | 148/302 |
| 258609 | 3/1988 | European Pat. Off. | 148/302 |
| 60-77960 | 2/1985 | Japan . | |
| 61-295355 | 12/1986 | Japan . | |
| 63-62842 | 3/1988 | Japan . | |

OTHER PUBLICATIONS

Concerned European Action on Magnets Newsletter, report on Brighton General Meeting of April 20–21, 1990.

Sagawa, M. et al., "Improved Corrosion and Temperature Behavior of Nd–Fe–B Magnets", DC01 Interney, Brighton U.K., Apr. 1990.

Tevaud, P. et al., "Nouveaux Types D'Aimants NdFeB A Compartment Ameliore Vis a Vis de la Corrosion et de la Temperature", SEE Conference, Genoble, France, Jun. 1990.

Journal of Applied Physics, vol. 55, No. 6, Part IIA, Mar. 15, 1984, *New Material for Permanent Magnets on a Base of Nd and Fe* (invited), M. Sagawa et al.

*Primary Examiner*—R. Dean
*Assistant Examiner*—George Wyszomierski
*Attorney, Agent, or Firm*—Fish & Richardson

[57] ABSTRACT

An Nd-Fe-B sintered magnet which has 0.5 %/°C. or more of temperature-coefficient of coercive force (iHc) and a composition that R=11–18 at % (R is one or more rare-earth elements except for Dy, with the proviso of 80 at % ≦(Nd+Pr)/R≦100 at %), B=6–12 at %, and balance of Fe and Co (with the proviso of Co is 25 at % or less relative to the total of Co and Fe (including 0 % of Co)) and impurities, is improved to have 15 kOe or more of coercive force (iHc) by means of further containing 2–6 at % of V and modifying the minority phase such that B in excess of a stoichiometric composition of $R_2Fe_{14}B$ compound-phase essentially does not form $RFe_4B_4$-compound minority phase but forms a finely dispersed V-T-B compound minority phase (T is fe, and in a case of containing Co, T is Fe and Co).

20 Claims, 5 Drawing Sheets

0.5 μm

PERMANENT MAGNET AND METHOD FOR PRODUCING THE SAME

BACKGROUND OF INVENTION

1. Field of Invention

The present invention relates to a permanent magnet, more particularly an Nd-Fe-B sintered magnet, as well as to a method for producing the same.

In the Nd-Fe-B magnets there are melt-quenched magnets and sintered magnets. Essentially, the melt-quenched magnet is magnetically isotropic. There is a proposed method for rendering the melt-quenched magnet anisotropic, residing in crushing a strip obtained by melt-quenching to produce powder, hot-pressing and then die-upsetting the powder. This method is however not yet industrially carried out, since the production steps are complicated.

2. Description of Related Arts

Nd-Fe-B sintered magnet is developed by the present inventor et al. It has outstanding characteristics in that it exhibits excellent magnetic property in terms of 50 MGOe of maximum energy product (BH)max in a laboratory scale and 40 MGOe even in a mass production scale; and, the cost of raw materials is remarkably cheaper than the rare-earth cobalt magnet, since the main components are such cheap elements as Fe and B, and Nd (neodymium) and Pr (praseodymium), whose yielding amount is relatively high in the rare earth elements. Representative patents of the Nd-Fe-B sintered magnet are Japanese Unexamined Patent Publication No. 59-89401, Japanese Unexamined Patent Publication No. 59-46008 (Japanese Examined Patent Publication No. 61-34242, Japanese Patent No. 14316170, Japanese Unexamined Patent Publication No. 59-217003), U.S. Pat. No. 4,597,938 and European Patent No. EP-A-0101552. As an academic paper, there is "New Material for permanent magnets on a base of Nd and Fe (invited)", M. Sagawa et al, J. Appl. Phys., 55, No. 6, Part II, p 2083/2087 (March, 1984).

A permanent magnet is exposed, after magnetization, to an inverse magnetic field due to various reasons. A permanent magnet must have a high coercive force in order that irreversal demagnetization does not occur even after exposure to a strong reverse magnetic field. Recently, along with size reduction of and efficiency-increase of appliances, inverse magnetic field applied to the appliances is increasing more and more. In a motor, for example, a magnet is exposed after its magnetization to a strong self demagnetization, until it is mounted in a yoke. After mounting, the magnet is exposed, during energization, to an inverse magnetic field from a coil and to a magnetic field which corresponds to the permeance of a magnetic circuit. The inverse magnetic field from the coil reaches the maximum at start. When a motor stops due to an excessive load and is then immediately restarted by switching on, the most severe load is applied to the magnet. In order to withstand this and suppress the irreversible demagnetization field, a permanent magnet must have a coercive force as high as possible.

Under recent progress of appliances, the level of load, which is required for magnets, is unseen heretofore. In an appliance for extracting a strong emission light in an accelerator referred to as an undulator or wiggler, there is a proposal of structure that completely magnetized plates of permanent magnets are bonded with one another in such a manner that N poles face one another and alternately S poles face one another. Obviously, for such application the permanent magnets having a high coercive force are necessary. There is a trend that such use of permanent magnets is increasing more and more in future.

The coercive force also has a relationship with the stability of a permanent magnet. When a permanent magnet is allowed to stand after magnetization, irreversible demagnetization occurs little by little. In order to lessen the irreversible change of magnetization with time, coercive force should be as higher as possible than the inverse magnetic field under using state. Accordingly, there are more and more requests for permanent magnets having a high coercive force.

In addition, when a permanent magnet is exposed under high temperature, since the coercive force lowers at a high temperature, its temperature characteristics become important. Temperature coefficient of coercive force, which exerts an influence upon the temperature-characteristics of coercive force, is from 0.3 to 0.4%/° C. for the melt-quenched strip magnet, and is slightly lower than this value for the melt-quenched and then anisotropically treated strip magnet. Temperature coefficient of coercive force is 0.5%/° C. or more for the sintered magnet.

The temperature-coefficient of a sintered magnet varies depending upon a measurement temperature range and is greater at a lower temperature. The temperature coefficient ($\beta$) of the coercive force herein is determined by the following formula.

$$\beta = \frac{\Delta iHc}{iHc \times \Delta T}$$

ΔiHc: difference (kOe) in the intrinsic coercive force (iHc) in the temperature change of from 20° C. to 120° C.

iHc: intrinsic coercive force at 20° C. (kOe)

ΔT: temperature difference (100° C.).

The measuring interval of temperature coefficient of coercive force (iHc) is set from 20° to 120° C., since the temperature interval becomes 100° C.

Since the temperature coefficient of coercive force (iHc) is 0.5%/° C. and is very high for the Nd-Fe-B sintered magnet, the intrinsic coercive force (iHc), hereinafter referred to as the coercive force (iHc), is lowered at a high temperature to make the magnet unusable. Specifically speaking, in the case for permeance coefficient =1, the limiting usable temperature of the Nd-Fe-B sintered magnet is approximately 80° C. The Nd-Fe-B sintered magnet, whose temperature coefficient of coercive force (iHc) is 0.5%/° C. or more and is very high irrespective of the composition, could therefore not be used at a high temperature and as parts of automobiles and motors used at temperature raising to 120°-130° C. during use.

Various devices have been made to enhance the coercive force of Nd-Fe-B sintered magnet. Coercive force (iHc) of the Nd-Fe-B sintered magnet having standard composition $Nd_{15}Fe_{77}B_8$ is approximately 6 kOe. Considering that the residual magnetization (Br) of this magnet exceeds 12 kG, the coercive force (iHc)=6 kOe is too low so that its application scope is extremely limited. One of the most successful methods for enhancing the coercive force was heat treating the $Nd_{15}Fe_{77}B_8$ sintered magnet, subsequent to sintering, at 600° C., which increased the coercive force (iHc) to 12 kOe (M. Sagawa et al. J. Appl. Phys. vol. 55, No. 6,15, March 1984). This was a great achievement but higher coercive force is necessary from a practical point of view.

Japanese Unexamined Patent Publication No. 61-295355 discloses a Nd-Fe-B sintered magnet containing a boride phase of BN, $ZrB_2$, CrB, $MoB_2$, $TaB_2$, $NbB_2$, and the like. According to the explanation in this publication: it is effective for providing a high coercive force to lessen the grain size of a sintered body as possible; the boride particles added to the main raw materials suppress of grain growth during sintering; and, the coercive force (iHc) increases by 1–2 kOe due to the suppressed grain growth. In addition, according to the above publication, it is indispensable for obtaining a permanent magnet having improved magnetic properties that the $R_2Fe_{14}B$ phases be surrounded along their boundary by R rich phases and B rich phases.

Japanese Unexamined Patent Publication No. 62-23960 discloses to suppress the grain growth by using such borides as $TiB_2$, BN, $ZrB_2$, $HfB_2$, $VB_2$, NbB, $NbB_2$, TaB, $TaB_2$, $CrB_2$, MoB, $MoB_2$, $Mo_2B$, WB, $WB_2$, and the like. Nevertheless, only slight enhancement of coercive force is attained by the technique of suppressing the grain-growth due to addition of these borides. Such borides incur generation of $Nd_2Fe_{17}$ phase which is magnetically detrimental. The addition amount of borides is therefore limited to a relatively small amount. Most of the borides, such as BN and TiB, impede the sintering and densification of the sintered product.

Explorations have also been made for methods of enhancing the coercive force by means of additive element(s). Virtually all of the elements in Periodic Table have been tested. The most successful method among them was the addition of heavy rare-earth elements, such as Dy. For example, when 10% of Nd of $Nd_{15}Fe_{77}B_8$ is replaced to provide $Nd_{13.5}Dy_{1.5}Fe_{77}B_8$, the coercive force (iHc) amounts to $\geqq 17$ kOe. Because of the discovery that Dy is effective for enhancing the coercive force (iHc), Nd-Fe-B sintered magnet is at present being used in a broad field of application.

Various additive elements other than the heavy rare-earth elements were also tested. For example, in Japanese Unexamined Patent Publications Nos. 59-218704 and 59-217305, V, Nb, Ta, Mo, W, Cr and Co were added and heat treatment was devised in various ways. However, the coercive force (iHc) obtained is low and the effects obtained were exceedingly inferior to those attained by Dy. Al is effective for enhancing the coercive force (iHc), although not as prominent as Dy and Pr, but disadvantageously drastically lowers Curie point.

Although Dy provides excellent coercive-force characteristics, the abundance of Dy in ores is approximately 1/20 times of Sm and is very small. If Nd-Fe-B sintered magnets with Dy additive are mass-produced, Dy is used in amount greater than the amounts of respective elements balanced in the rare-earth resources. There is a danger that the balance is destroyed and the supplying amount of Dy soon becomes tight.

Tb and Ho, which belong to rare-earth elements as Dy, have the same effects as Dy, but, Tb is even more rare than Dy and is used for many applications such as opto-magnetic recording material. The effects of Ho for enhancing the coercive force (iHc) is exceedingly smaller than that of Dy. In addition, the resource of Ho is poorer than Dy. Tb and Ho therefore practically speaking cannot be used.

As is described hereinabove there are two methods for producing Nd-Fe-B series magnet. According to the melt-quenching method, alloy melt is blown through a nozzle and impinged upon a roll rotating at a high speed to melt-quench the same. A high coercive force is obtained by this method by means of adjusting the rotation number of a roll and the conditions of post-heat treatment after the melt-quenching.

The melt-quenched magnet has a grain size of 0.1 μm or less and is fine. Therefore, even if a melt-quenched magnet has the same composition as the Nd-Fe-B sintered magnet, the former magnet is characterized by a higher coercive force than the latter magnet. In addition, mechanism of coercive force of the melt-quenched magnet is pinning type and hence is different from the nucleation type of sintered magnet. The temperature coefficient of coercive force (iHc) of melt-quenched magnet is 0.3–0.4%/° C. and is hence lower than 0.5%/° C. or more of the sintered magnet. This is also a feature of the melt-quenched magnet. Contrary to this, the melt-quenched magnet involves a problem in the properties other than the coercive force. That is, the melt-quenched magnet is isotropic in the state as it is. Special technique is necessary for rendering the melt-quenched magnet to anisotropic. The isotropic magnet exhibits Br approximately ½ times and $(BH)_{max}$ approximately ¼ times those of anisotropic magnet and cannot provide high performance. The hot-pressing and then die upsetting method causes a deformation work which aligns the crystal orientation. Although a high performance is obtained by this method, the process is complicated.

Generally, the production method of sintered magnet is for example as follows.

(a) Melting

An alloy ingot having a target composition or alloy ingots having a few kinds of the compositions are obtained.

(b) Rough Crushing

Roughly crushed powder under 35–100 mesh is obtained by a jaw crusher and a disc mill or the like.

(c) Fine pulverizing

Fine powder having an average grain size of 3 μm or less is obtained by a jet mill or the like.

(d) Press under magnetic field

Compressing is carried out for example in a magnetic field of 13 kOe with a pressure of 2 ton/cm$^2$.

(e) Sintering

Sintering is carried out in vacuum or Ar gas at 1000° to 1160° C. for 1–5 hours.

(f) Heat treatment

Heat treatment is carried out at 600° C. for 1 hour.

Nd-Fe-B sintered magnets produced by such methods as described above have already been industrially produced in large amounts and have been used in magnetic resonance imaging (MRI), office automation (OA) and factory automation (FA) equipment, various motors, actuators (VCM), a driving part of the printer head.

In the sintering process of Nd-Fe-B sintered magnet (hereinafter simply referred to as Nd-Fe-B magnet), the green compact powder is densified. An aim of the densification is as follows. In the well prepared powder, Nd-rich alloy powder, whose melting point is far lower than that of the $Nd_2Fe_{14}B$ main phase, is uniformly dispersed, and the Nd-rich phase functions so that the liquid-phase sintering is realized. The liquid phase of Nd rich phase is distributed over the surface of the main-phase powder. The liquid-phase sintering enables densification at a relatively low temperature, without incurring grain growth appreciably.

Another important function of the Nd rich phase is to repair defects on the surface of the main-phase powder, which defects generate during the pulvering step. The most serious defects on the surface of main-phase powder are Nd-deficient layer formed due to preferential oxidation of Nd. The Nd rich phase supplies, from its liquid phase, Nd to this layer, thereby repairing the defects on the main-phase powder and hence enhancing the coercive force.

High densification of the sintered body is attained at a relatively low temperature by the liquid-phase sintering. However, it is desirable that the sintering temperature be high and close to the melting point of main phase and sintering be carried out for a long time.

However, when the sintering is carried out at high temperature and/or for a long time in the conventional methods, in a case that 3 μm raw materials-powder is used, the crystal grains of main phase coarsen to 15 μm or more, with the result that the coercive force of Nd-Fe-B magnet is lowered. The coercive force (iHc) of Nd-Fe-B magnet, which is obtained by an heretofore ordinary sintering method without coarsening the crystal grains of main phase, is approximately 12–13 kOe. The addition amount of borides is therefore limited to a relatively small amount.

The conventional Nd-Fe-B magnets are applied for OA and FA equipment, where environment is relatively moderate and of low-temperature and low-humidity.

It is known that the Nd-Fe-B magnets are less liable to rust in dry air than the SmCo magnets (R. Blank and E. Adler: The effect of surface oxidation on the demagnetization curve of sintered Nd-Fe-B permanent magnets, 9th International Workshop on Rare Earth Magnets and Their Applications, Bad Soden, FRG. 1987).

The Nd-Fe-B magnet is liable to rust in water or in a high humidity environment. As countermeasures for rusting liability of Nd-Fe-B magnet various surface-treatment methods, such as plating and resin-coating, are employed. However, since every coating by the surface treatment has defects, such as pinholes and cracks, water can intrude through the defects of coating to the surface of an Nd-Fe-B magnet and then vigorously oxidize the magnet. When the oxidation occurs, properties of a magnet are rapidly deteriorated and, rust, which floats on the surface of a magnet, impedes the functions of an appliance.

One of the previously proposed methods for improving the corrosion resistance to water, not relying on the surface treatment is that Al or Co is added to the Nd-Fe-B magnet. However, Al and Co can improve the corrosion resistance only slightly.

The corrosion resistance of Nd-Fe-B magnet is studied also from the view point of structure.

Sugimoto et al made a study on the mechanism of water-corrosion of Nd-Fe-B magnet (Corrosion mechanism of Nd-Fe-B magnet alloy. Sugimoto et al, Autumn Lecture Meeting of Japan Institute of Metals. No. 604, (October, 1987)). It has been clarified by this study that the corrosion speed in the water is in the following order of 3 > 2 > 1 , wherein 1 is $Nd_2Fe_{14}B$ phase, 2 is Nd rich-phase (e.g., Nd-10 wt % Fe), and 3 is $NdFe_4B_4$ phase (B rich phase), which phases constitute the sintered alloy having a standard composition of 33.3 wt % of Nd, 65.0 wt % of Fe, 1.4 wt % of B, and 0.3 wt % of Al.

SUMMARY OF THE INVENTION

1. Tasks to be solved by the present invention

The Nd-Fe-B magnet with addition of approximately 1.5% of Dy exhibits at room temperature 17 kOe or more of coercive force (iHc) and approximately 5 kOe of coercive force (iHc) at 120°–140° C. Although the temperature coefficient of coercive force (iHc), i.e., 0.5%/° C. or more, is not improved by the Dy addition, it is satisfactory that the coercive force (iHc) which can overcome inverse magnetic field, is obtained even at high temperature. Most of rare-earth magnets has approximately 10 kG of residual magnetization. Magnetic circuit is therefore designed in the using condition of magnet being $B/H \geqq 1$ and targetting $iHc \geqq 5$ kOe.

It has been considered that the Dy addition method is employed for Nd-Fe-B magnet used for an AC motor (R. E. Tompkins and T. W. Neumann. General Electric Technical Information Series, Class 1 Report No. 84crd312. November 1984). When the Nd-Fe-B magnets are used for starter-motors and generators of automobiles as well as general high-power motors, magnetic properties must be stable at 180°–200° C., which is an extremely severe environment. As high as 4% or more of Dy must therefore be added. Since such an addition of Dy in a great amount involves a problem in the supply of Dy resources, the Nd-Fe-B magnet cannot be used for high temperature-applications, such as high-power-motors, automobiles and the like.

Japanese Unexamined Patent Publication No. 61-295355, supra, which teaches to suppress the grain growth by borides, recites the following coercive force (iHc). $Nd_{15}Fe_8B_{77}$ magnet has 14.8 kOe of coercive force (iHc). When 0.3 at % of $MoB_2$ is added to the above magnet, coercive force (iHc) becomes 15.2 kOe. This coercive force (iHc) is very high. Note, however, the coercive force (iHc) obtained without the addition of $MoB_2$ is 14.8 kOe and is also very high. Over this value only 0.4 kOe of coercive force is hence increased. In order to obtain very high coercive force (iHc) of 14.8 kOe, various strict precautions are necessary such as the rare-earth containing powder is not brought into contact with oxygen at the most, distribution of grain size of powder is made sharp at the most, and further the sintering condition is strictly controlled. It is not practical to set and adjust the process conditions as above.

The grain growth during sintering is suppressed and hence the coercive force (iHc) can be enhanced by utilizing borides. According to the disclosure of Japanese Unexamined Patent Publication No. 61-295355 supra, the enhancement of coercive force (iHc) by the suppression of grain growth is 2 kOe at the maximum. Therefore, if the technique for suppressing the grain growth is applied to a magnet (15 at % Nd-77 at % Fe-8 at % B) heat-treated at 600° C. (coercive force (iHc) is 12 kOe as described above), the coercive force (iHc) obtained is presumably 14 kOe. This value is however unsatisfactory.

It is therefore an object of the present invention to provide an Nd-Fe-B sintered magnet, in which the coercive force (iHc) is enhanced without use of, or only small use of, Dy.

Specifically, the object of the present invention resides in that the coercive force (iHc) of the sintered and then heat-treated Nd-Fe-B magnet, whose temperature coefficient of the coercive force (iHc) is 0.5%/° C. or more, is enhanced by 3 kOe or more, by means of using another element than Dy and facilitating the industrial production. In this regard, the coercive force (iHc) of such sintered magnet decreases 60% or more upon the temperature rise of 120° C., thereby incurring decrease of the coercive force (iHc) of from for example 12 kOe to 4.8 kOe or less. Contrary to this, in the melt-quenched magnet, whose temperature coefficient of the coercive force (iHc) is approximately 0.3%/° C., the decrease of coercive (iHc) force is only 36% and from 12 kOe to approximately 7.7 kOe upon the temperature rise mentioned above. It is therefore essential to enhance the coercive force (iHc) of the Nd-Fe-B sintered magnet having a high temperature-coefficient of the coercive force (iHc).

It is another object of the present invention to provide an Nd-Fe-B sintered magnet having an improved corrosion resistance.

It is a further object of the present invention to provide a method for producing an Nd-Fe-B sintered magnet, wherein the coercive force (iHc) is enhanced more than heretofore and further an industrial production is facilitated.

2. Means for solution

The present invention is related to the structure of Nd-Fe-B magnet. In the Nd-Fe-B magnet, the matrix or main phase is the $R_2Fe_{14}B$ compound-phase (R is Nd and the other rare-earth elements). It has been ascertained that, because of strong magnetic anisotropy of this phase, excellent magnetic properties are obtained. In the Nd-Fe-B magnet, the magnetic properties are enhanced at a compositional range, in which both Nd and B are greater than the stoichiometrical composition of $R_2Fe_{14}B$ compound (11.76 at % of Nd, 5.88 at % of B, and balance of Fe). As is known, the excess Nd forms a minority phase, which is referred to as the Nd-rich phase and has a composition of R=85–97 at %, and Fe in balance (if any rare earth element other than Nd, which is contained in the sintered body, is also contained in the composition), and which plays an important role for the sintering and for enhancing the coercive force.

In addition, the excess B forms heretofore an $Nd_1Fe_4B_4$ compound phase which is referred to as the B rich phase. In some documents, the B rich phase is reported as $Nd_2Fe_7B_6$ or $Nd_{1.1}Fe_4B_4$. It has been made clear that every one of these compounds indicates the identical tetragonal compound. $NdFe_4B_4$ compound is a non-magnetic tetragonal crystal having the lattice constants of a=0.712 nm and c=0.399 nm but is magnetic at cryogenic temperature. In the conventional Nd-Fe-B sintered magnet, B in an amount greater than the stoichiometric composition of $R_2Fe_{14}B$ compound-phase forms $RFe_4B_4$ compound phase. In the Nd-Fe-B magnet having the standard composition the formation amount of $NdFe_4B_4$ compound phase calculated on the phase diagram is approximately 5%. Enhancement of coercive force by the B rich phase is slight. Dy as well as Tb and Ho enhance the magnetic anisotropy of $R_2Fe_{14}B$ compound-phase, thereby enhancing the coercive force (iHc) and stability at high temperature compared with the case free of Dy and the like.

The present inventor further researched and discovered the following. That is, in a V-added Nd-Fe-B magnet having a specified composition the $NdFe_4B_4$ phase (B rich phase) is suppressed to the minimum amount, and a compound phase other than the $NdFe_4B_4$ phase, i.e., a V-Fe-B compound phase, whose presence is heretofore unknown, is formed and replaces for the $NdFe_4B_4$ phase. The absolute value of the coercive force (iHc) is exceedingly enhanced and the stability at high temperature is improved due to the functions of both V-Fe-B compound phase and particular composition.

An Nd-Fe-B series sintered magnet (Nd-Fe-B magnet) according to the present invention has 0.5%/° C. or more of temperature-coefficient of coercive force (iHc) and a composition that R=11–18 at % (R is one or more rare-earth elements except for Dy, with the proviso of 80 at % $\leqq$ (Nd+Pr)/R $\leqq$ 100 at %), B=6–12 at %, and balance of Fe and Co (with the proviso of Co is 25 at % or less relative to the total of Co and Fe (including 0% of Co) and impurities, and is characterized in that B in excess of a stoichiometric composition of $R_2Fe_{14}B$ compound-phase essentially does not form $RFe_4B_4$-compound minority phase but forms a finely dispersed V-T-B compound minority phase (T is Fe, and in a case of containing Co, T is Fe and Co), and, further, the magnet exhibits 20 MGOe or more of maximum energy product and 15 kOe or more of coercive force (iHc).

Another Nd-Fe-B series sintered magnet (Nd-Fe-B magnet) according to the present invention has 0.5%/° C. or more of temperature-coefficient of coercive force (iHc) and a composition that R=11–18 at % (R is rare-earth elements, $R_1$=Nd+Pr, $R_2$=Dy, with the proviso of 80 at % $\leqq$ ($R_1+R_2$)/R $\leqq$ 100 at %), $0 \leqq R_2 \leqq 4$ at %, B=6–12 at %, and balance of Fe and Co (with the proviso of Co is 25 at % or less relative to the total of Co and Fe (including 0% of Co) and impurities, and is characterized in that B in excess of a stoichiometric composition of $R_2Fe_{14}B$ compound-phase essentially does not form $RFe_4B_4$-compound minority phase but forms a finely dispersed V-T-B compound minority phase (T is Fe, and in a case of containing Co, T is Fe and Co), and, further, the magnet exhibits 20 MGOe or more of maximum energy product and 15+3x of coercive force (kOe) (x is Dy content (at %), with the proviso that when 15+3x is 21 kOe or more, the coercive force is 21 kOe or more).

A method for producing an Nd-Fe-B series sintered magnet (Nd-Fe-B magnet) according to the present invention is characterized by carrying out liquid-phase sintering while dispersing among the particles of $R_2Fe_{14}B$ compound-phase (R is one or more rare-earth elements whose main components are Nd and/or Pr, fine particles of V-T-B compound phase in such an amount that V in the sintered body amounts to 2–6 at %. In the Nd-Fe-B magnet produced by this method, an excess B more than the stoichiometric composition of $R_2Fe_{14}B$ compound-phase virtually does not form the $RFe_4B_4$ phase.

DESCRIPTION OF PREFERRED EMBODIMENTS

Microstructure

The V-T-B compound (phase) may hereinafter referred to as V-Fe-B compound (phase).

The V-Fe-B compound phase is formed in the constitutional structure of sintered body, as long as Nd, Pr, (Dy), B, Fe and V are within the above described range. When these components are outside the above ranges, the constitutional phases of sintered magnet are $R_2Fe_{14}B$ compound-phase, Nd rich phase and B rich phase as in the conventional Nd-Fe-B magnet, and hence the V-T-B compound phase is not formed. Alternately, the formation amount of V-T-B compound is very small, or $Nd_2Fe_{17}$ phase which is detrimental to the magnetic properties is formed.

Figure 2A:
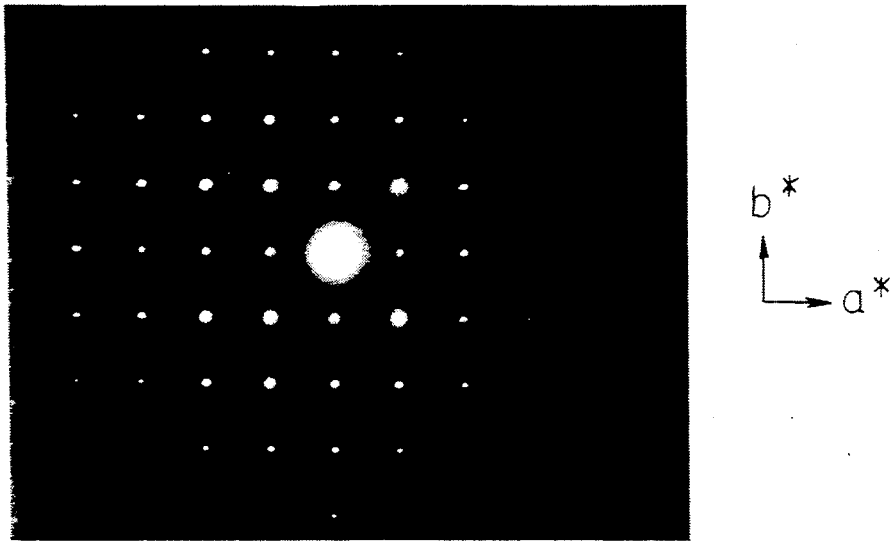
FIG. 2(A) and FIG. 2(B) show the electron diffraction of V-Fe-B compound contained in $Nd_{15}Fe_{bal}V_4B_8$ magnet.
Figure 2B:
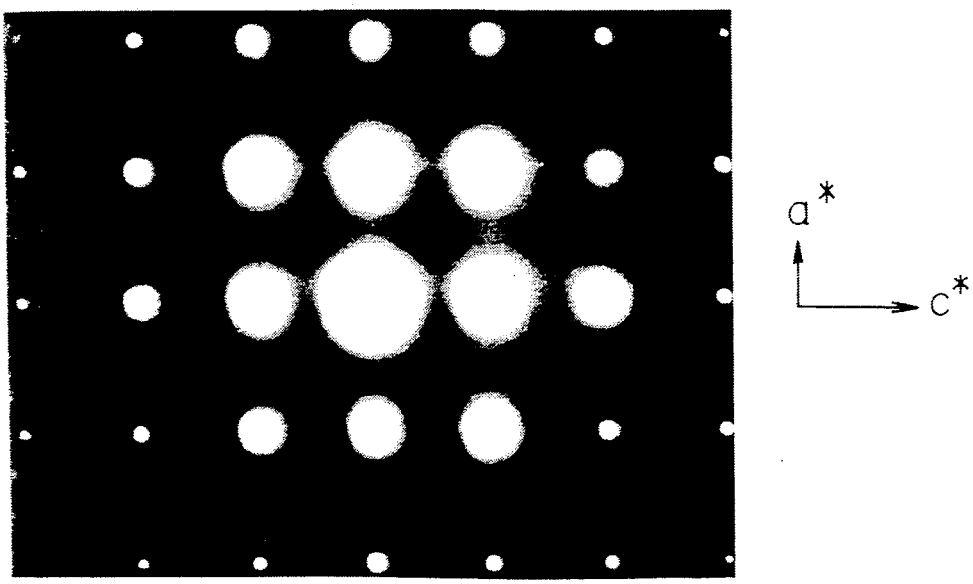

The V-Fe-B compound phase in the sample of No. 1 in Table 1 described below turned out, as a result of the EPMA measurement, to have a composition of 29.5 at % of V, 24.5 at % of Fe, 46 at % of B, and trace of Nd. The V-Fe-B compound turned out, as a result of electron diffraction, to have a unit cell of tetragonal structure having lattice constants of a=5.6 Å and c=3.1 Å. An electron diffraction-photograph used for analysis of the crystal structure of V-Fe-B compound is shown in FIGS. 2(A) and (B). For identification of crystal structure, it is now compared with those of already known compounds. At present, tetragonal $V_3B_2$ is the most probable. Presumably, a part of V of this compound is replaced with Fe. Elements other than the above mentioned can be dissolved in solid solution of that compound. Depending upon the composition, additive elements, and impurities of sintered bodies, V of that compound can be replaced with various elements having similar property to V. B of that compound can be replaced with C which has a similar property to B. Even in these cases, improved coercive force (iHc) is obtained, as long as in the sintered body is present the phase (possibly, $(V_{1-x}Fe_x)_3B_2$ phase) of bindary Fe-B compound, part of which Fe is replaced with V and is occasionally additionally replaced with Co and the M elements described hereinbelow. The B rich phase, which is contained in the most of the conventional Nd-Fe-B magnets, is gradually lessened and finally becomes zero with the increase in the formation amount of V-Fe-B compound phase. When the B rich phase, which contains approximately 11 at % of Nd, is replaced with V-Fe-B compound, in which virtually no Nd is dissolved as solid solution, remainder of Nd constitutes the Nd rich phase, which is essential for the liquid-phase sintering, with the result that Nd is effectively used for improving the magnetic properties. That is, the Nd-Fe-B magnet according to the present invention, which is essentially free of the B rich phase, exhibits a higher coercive force (iHc) than the conventional Nd-Fe-B magnet having the same composition as the former magnet and containing B more than the stoichiometric composition of $R_2Fe_{14}B$. The excess boron more than the stoichiometric composition of $R_2Fe_{14}B$ means the B which is surplus more than $(1/17)\times 100$ at % = 5.8 at %, for example 2.2 at % in the case of 8 at % of B.

Figure 1:
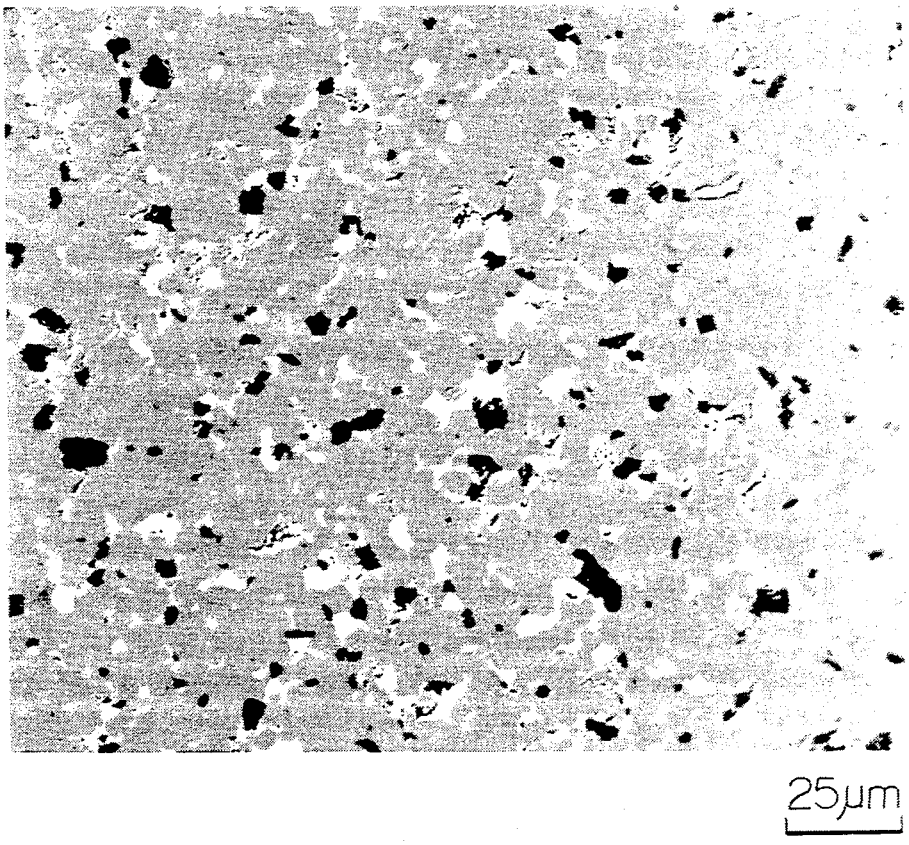
FIG. 1 is an EPMA image of the Nd-Fe-B magnet according to the present invention.
Figure 3:
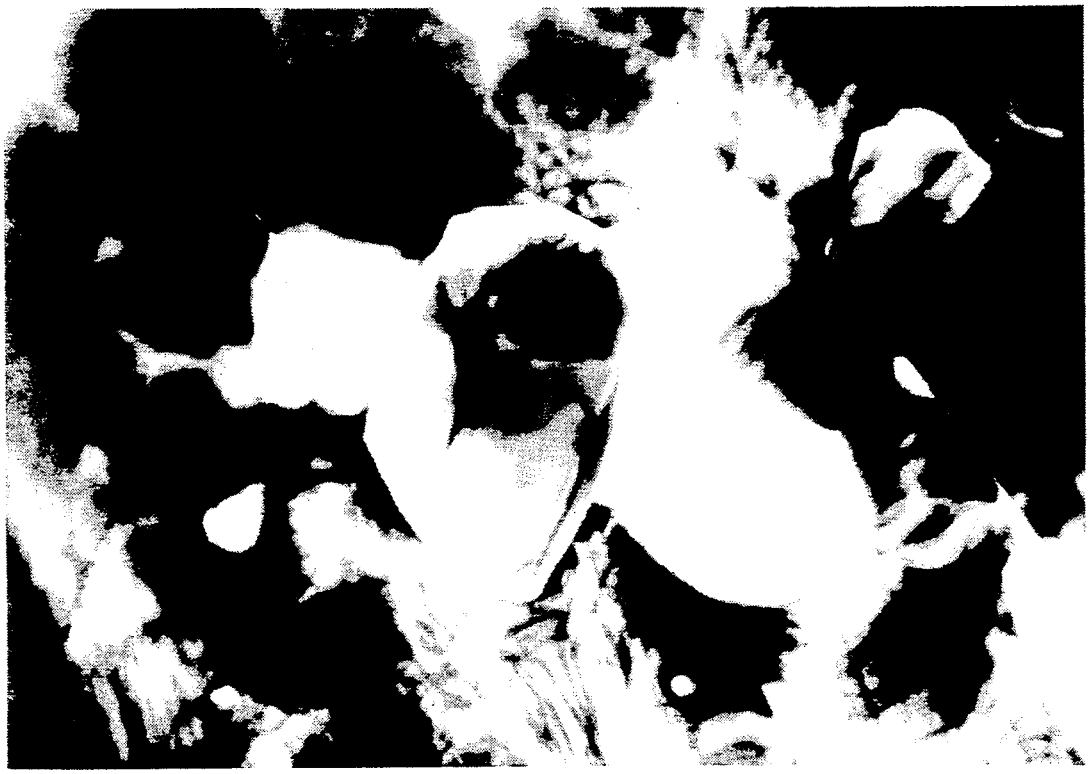
FIG. 3 shows the transmission-electron micrograph of $Nd_{15}Fe_{bal}V_4B_8$ magnet.

In an Nd-Fe-B magnet, whose coercive force (iHc) is particularly improved, the B rich phase is completely inappreciable or extremely slight even if partially appreciable. As is shown in EPMA image of FIG. 1, the V-Fe-B compound phases dispersed in the grain boundaries and triple points of grain boundaries of $R_2Fe_{14}B$ compound-phase. By an observation of an electron microscope with a further higher resolving power, it turned out, as shown in FIG. 3, that finer V-Fe-B compound phase dispersed mainly at the grain boundaries and partly within the grains. The properties of Nd-Fe-B magnet are better in the case where the V-Fe-B compound phase is dispersed mainly in the grain boundaries, than the case where the V-Fe-B compound phase is dispersed mainly within the grains. Ideally, almost all of the crystal grains of $R_2Fe_{14}B$ compound-phase are in contact at their boundaries with a few or more of the particles of V-Fe-B compound phase.

INVENTIVE METHOD

The method according to the present invention is hereinafter described in detail.

According to the method of the present invention, particles of the V-T-B compound phase are dispersed uniformly and finely during the liquid-phase sintering. The V-T-B compound phase dispersed as mentioned above exerts a strong influence upon the distribution, amount and presence (absence) of the various minority phases contained in the sintered body. As a result, the Nd-Fe-B magnet having the characterizing structure is obtained.

When T is Fe, the V-Fe-B compound phase must be an intermetallic compound, in which an approximate integer ratio is established in the atom numbers of V+Fe to B. The V-Fe-B compound, which is present during sintering according to the present invention, may be such borides as $V_3B_2$, $V_5B_6$, $V_3B_4$, $V_2B_3$, $VB_2$ or the like, in which preferably 5 at % or more of V is replaced with Fe. The atom ratio between V+B and B occasionally deviates from the strict integer ratio. When two or more kinds of V-Fe-B compounds are mixed, the resultant mixture as a whole does not provide integer ratio. Even such V-Fe-B compound(s) may be used in the present invention, provided that the constitutional atoms of the respective compound(s) have approximate integer ratio.

The particles of V-Fe-B compound used as an additive before sintering must be fine. If such particles are considerably coarser than the main phase particles, then the former particles do not disperse well in the latter particles, with the result that reactions of V-Fe-B compound-phase with the other phases become unsatisfactory and hence its influence upon the various minority phases is weakened. The particles of V-Fe-B compound must therefore be as fine as, or finer, than the main-phase particles. It is also important that the particles of V-Fe-B compound are satisfactorily uniformly dispersed in the powder as a whole. The grain boundaries are improved at the most, when the particles of V-Fe-B compound are dispersed in such a manner that at least one of these particles is brought into contact with every one of the sintered particles of the main phase.

The amount of V-Fe-B compound-particles must be such that V is contained from 2 to 6 at % in the sintered body. If the amount is less than 2 at %, it is impossible to realize an effect that V-Fe-B phase satisfactorily replaces the $RFe_4B_4$ phase. On the other hand, if the amount is more than 6 at %, the residual magnetization is lessened and detrimental $Nd_2Fe_{17}$ phase, which impairs the magnetic properties, is formed.

Methods for obtaining the powder for sintering, in which the above described V-Fe-B compound-particles are finely dispersed, are hereinafter described.

There are two methods for obtaining the powder of V-Fe-B compound.

(1) An ingot of V-Fe-B compound is pulverized.

(2) An Nd-Fe-V-B alloy-ingot containing the V-Fe-B compound is formed, and then the ingot is pulverized, simultaneously pulverizing the V-Fe-B compound. The powder mixture of V-Fe-B compound-phase together with the other phases is obtained.

Various devices are possible for obtaining the powder, in which the particles of V-Fe-B compound are uniformly and finely dispersed. Since the V-Fe-B compound is harder and hence more difficult to pulverize than the $R_2Fe_{14}B$ compound-phase, V-Fe-B compound is not satisfactorily refined even when the $R_2Fe_{14}B$ is pulverized to fine particles of predetermined size. Longer pulverizing time is therefore necessary for obtaining the V-Fe-B compound particles than that for obtaining the $R_2Fe_{14}B$ particles. The powder, in which the respective phases reach a predetermined average size, is mixed for a satisfactorily long time, so as to attain uniform dispersion of the respective phases. In order to pulverize the respective phases as the separate particles as described above, the pulverizing time is varied depending upon the hardness, so that the respective phases are size-reduced to a predetermined average grain-diameter. The resultant powder is then uniformly mixed satisfactorily to obtain the starting powder of sintering according to the present invention. Depending upon the accuracy of pulverizing, composite particles may be obtained, in which the particles of V-Fe-B and $R_2Fe_{14}B$ are not separated from but adhere to each other. Such composite particles may also be used as the starting material of sintering according to the present invention.

Possible alloy or combinations of alloys used in the present invention are for example as follows.

(1) An R-poor alloy, whose R is poorer than the $R_2Fe_{14}B$, an R rich alloy, whose R is richer than $R_2Fe_{14}B$, and V-Fe-B compound (2) An R-rich alloy, whose R is richer than $R_2Fe_{14}B$, and V-Fe-B compound (3) An R-rich alloy, whose R is richer than $R_2Fe_{14}B$, and V-Fe-B compound, and an R-Fe-B-V alloy (4) Two or more kinds of R-Fe-B-V alloys having different compositions (5) One kind of R-Fe-B-V alloy.

Combinations other than above are possible but are not recommended since they are complicated.

In the R-poor alloy of (1), above, the constitutional phases are, depending upon the composition, three of $R_2Fe_{14}B$, $R_2R_{17}$, Fe and $Fe_2B$. The constitutional phases of the R-rich alloy above are $R_2Fe_{14}B$, R-rich phase and $R_1Fe_4B_4$. Generally, when the phases, whose pulverizing easinesses is different from one another, are pulverized simultaneously by means of an attritor or the like, the resultant powder has a broad distribution of the grain size and its magnetic properties are poor.

(1), (2) and (3) are superior to (4) and (5), since the respective alloys can be pulverized separately and then mixed with each other. (4) and (5) are however sometimes superior to (1), (2) and (3) in the light of productivity. The constitutional phases of cast alloys according to (4) and (5) are particles of the $R_2Fe_{14}B$, R rich and V-Fe-B phases having a size of several hundreds μm. In order to uniformly disperse throughout the powder the $R_2Fe_{14}B$ compound-phase 1–5 μm in size and fine particles of V-Fe-B compound, a method, which has not classification effect and pulverizes every phases for identical time and to identical degree, is undesirable since it is difficult to obtain the powder, in which the fine particles of V-Fe-B compound are uniformly and finely dispersed. When the crushed powder of alloys according to (4) and (5) are subjected to pulverizing by a jet mill with the use of nitrogen gas, the particles, whose average grain-diameter is reduced to a predetermined one, are successively collected in vessels attached to a cyclone. The pulverizing time is therefore automatically adjusted in accordance with the hardness and toughness of the respective phases. The powder of respective phases, which is suitable for the present invention, is therefore prepared even from the alloys according to (4) and (5) having the mixed phases. Due to the difference in the pulverizing property of the respective phases, the respective phases tend to separate from each other and are collected separately. The powder of alloys according to (4) and (5), as they are pulverized by a jet mill, is therefore undesirable, because a sintered Nd-Fe-B magnet produced by using such powder contains a significant amount of the B rich phase remained.

The crystal grains of V-Fe-B compound-phase in the alloy-ingots of (4) and (5) are desirably fine. That is, since the particles of V-Fe-B compound is difficult to pulverize, it is desirable that the fine particles are already formed in an ingot. The alloy melt is therefore desirably rapidly cooled during solidification by means of using a small ingot or a water-cooled mold at casting of alloy after melting. It is then possible to disperse the V-Fe-B compound-particles in the powder of $R_2Fe_{14}B$ compound-phase having grain-diameter of 1–5 μm in average. If the average grain-diameter of $R_2Fe_{14}B$ compound-particles is less than 1 μm, chemical activity is so high as to render their handling difficult. On the other hand, if the average grain diameter is more than 5 μm, a high coercive force is difficult to obtain after sintering. For measuring average grain diameter of powder a Fisher sub-sieve sizer was used. It is necessary for obtaining high coercive force that the R rich phase is uniformly dispersed in the powder.

Subsequently, the sintering is carried out. The sintering must be liquid-phase sintering in order to obtain the effect for repairing the $R_2Fe_{14}B$ compound-phase by R-rich liquid phase. The known sintering temperature, time and atmosphere may be used in the present invention.

Heat treatment is carried out at a temperature of from 600° to 800° C. after sintering. This treatment causes an appreciable change in the crystal grain-boundaries and hence enhancement of coercive force (iHc) at room temperature by 7–11 kOe, and at 140° C. by 2–5 kOe.

The above described invention method is carried out irrespective of the composition of Nd-Fe-B magnet, as long as the excess B more than the stoichiometric composition of $R_2Fe_{14}B$ compound is present in the Nd-Fe-B magnet. However, the R content is desirably 10 at % or more in the final alloy composition, in the light of liquid-phase sintering. The B content of 6 at % or more is necessary for obtaining a high coercive force.

COERCIVE FORCE

Although the Nd-Fe-B magnet having 0.5%/° C. or more of temperature-coefficient of coercive force (iHc) exhibits a considerable decrease in the coercive force at a high temperature, the coercive force (iHc) obtained by the present invention is enough for using the inventive magnet for various appliances at a high temperature. The coercive force (iHc) of permanent magnet according to the present invention is hereinafter described. Note, however, that the production conditions are ordinary, particularly, the contact of oxygen with treated articles during production process (for example, the oxygen concentration in nitrogen gas used in the pulverizing in a jet mill), atmosphere in the pressing process, and the oxygen concentration of sintering atmosphere are ordinary ones such that the $Nd_{15}Fe_{77}B_8$ having optimum composition exhibits coercive force (iHc)=12 kOe after optimum heat treatment.

The coercive force (iHc) of Nd-Fe-B magnet according to claim 1 is 15 kOe or more. Since the coercive force (iHc) is enhanced by 3 kOe by addition of 1 at % of Dy, the coercive force (iHc) is $\geqq 15+3x$ kOe (x is Dy content by atomic %) in Nd-Fe-B magnet, in which Dy is added. However, since the applied maximum magnetic field of an electromagnet used in the experiments for measuring the demagnetizing curves until the completion of the present invention was 21 kOe, actual values could not be measured, when the coercive force (iHc) exceeded 21 kOe. Therefore, when the coercive force (iHc) calculated following the above formula exceeds 21 kOe, the inventive coercive force (iHc) is set at least 21 kOe or more.

Aluminum, which may be added to the Nd-Pr-(Dy)-Fe-B magnet having the composition according to the present invention, furthermore enhances the coercive force (iHc), presumably because aluminum in a small amount promotes fine dispersion of the V-T-B compound phases.

One standard, which is necessary for using the Nd-Fe-B magnet at a high temperature, is 5 kOe or more of the coercive force (iHc). Now consideration is made that temperature raises up to 140° C., as frequently seen when magnets are used for motors and the like. If the temperature-coefficient of coercive force (iHc) is, for example, 0.5%/° C., the coercive force (iHc) at room temperature must be 12.5 kOe or more. This value of coercive force (iHc) is fulfilled in the compositional range according to claim 1. If the temperature-coefficient of coercive force (iHc) is, for example, 0.6%/° C., the coercive force (iHc) at room temperature must be 17.8 kOe or more. This value of coercive force (iHc) is fulfilled by a compositional range according to claim 1 except for vicinities of the upper and lower limits, provided that aluminum is added to claim 1's composition. When the temperature coefficient of coercive force (iHc) is 0.7%/° C. or more, 5 kOe or more of the coercive force (iHc) is obtained at 140° C. by a composition with Dy addition. The coercive force (iHc) at 200° C. amounting to 5 kOe or more is obtained by a composition containing 3—approximately 5.5 at % of V, 13 at % or more of R, more than 1 at % of Dy and aluminum addition.

COMPOSITION

Reasons for limiting the compositions are as described above. In addition, if the contents are less than the lower limits, the coercive force (iHc) becomes low. On the other hand, if the contents are more than the upper limits, the residual magnetization becomes low. With regard to Al, there are further detrimental effects which become serious at a content more than 3 at % or more, that is, the Curie point is lower than 300° C., and change of residual magnetization depending on the temperature increases. Addition of V causes enhancement of the coercive force (iHc) but only slight decrease in the Curie point. When the amount of V is very high, since detrimental $Nd_2Fe_{17}$ phase is formed, not only is the residual magnetization reduced but also the coercive force (iHc) is reduced to impair the stability at high temperature. Nd and Pr are mainly used for the rare-earth elements (R), because both $Nd_2Fe_{14}B$ and $Pr_2Fe_{14}B$ have higher saturation magnetization and higher uniaxial crystal- and magnetic-anisotropies together than the $R_2Fe_{14}B$ compound-phase of the other rare-earth elements.

(Nd+Pr)/R is $\geqq 80$ at %, because high saturation magnetization and high coercive force (iHc) are obtained by setting high contents of Nd and Pr except for Dy. Dy enhances coercive force (iHc) at 140° C. and 200° C. by approximately 2 kOe/% and 1 kOe/%, respectively. The content of Dy is 4 at % or less, because Dy is a rare resource and further the residual magnetization considerably lowers at more than 4 at %.

Incidentally, not only highly refined rare-earth elements but also mixed raw-materials, such as dydimium, in which Nd and Pr remain unseparated, and Ce-dydimium, in which Ce remains unseparated, can be used as the raw material for rare-earth elements.

Co, which may partly replace Fe, enhances the Curie point and improves the temperature-coefficient of residual magnetization. If, however, Co amounts to 25 at % or more of the total of Co and Fe, the coercive force (iHc) is lessened due to the minority phase described hereinafter. The amount of Co must therefore be 25 at % or less of the total of Co and Fe. In the Co-containing Nd-Fe-B magnet according to the present invention, $Nd_2Fe_{14}B$ compound and V-Fe-B compound are changed to $R_2(FeCo)_{14}B$ compound and V-(FeCo)-B compound, respectively. In addition, (Co.Fe)-Nd phase generates as a new minority phase, which lowers the coercive force (iHc).

The present inventor added various elements to the above described Nd-Fe-B magnet and investigated influences of the additive elements on the coercive force (iHc). It turned out as a result that the coercive force (iHc) is slightly improved or is virtually not improved, but not incurring the decrease.

$M_1$ enhances the coercive force (iHc), as V does but not outstandingly as V does.

$M_2$ and $M_3$ have slight effect for enhancing the coercive force (iHc). However, $M_2$ and $M_3$ may be incorporated in the refining process of rare-earth elements and Fe. It is advantageous therefore from the cost of raw materials when the addition of $M_1$, $M_2$ and $M_3$ may be permitted.

$M_1$=0–4 at % ($M_1$=one or more of Cr, Mo and W), $M_2$=0–3 at % (one or more of Nb, Ta and Ni), and $M_3$=0–2 at % (one or more of Ti, Zr, Hf, Si and Mn).

Transition elements among the above elements replace for a part of T of V-T-B compound. When the addition amount of $M_1$, $M_2$ and $M_3$ exceeds the upper limits, the Curie point and residual magnetization are lowered.

The elements other than the above described ones are impurities. Particularly, ferroboron, which is frequently used as the raw material of boron, contains aluminum. Aluminum also dissolves from a crucible. Aluminum is therefore contained in 0.4 wt % (0.8 at %) at the maximum in the Nd-Fe-B magnet, even if aluminum is not added as an alloy element.

There are other elements which are reported to add to Nd-Fe-B magnet. For example, Ga is alleged to enhance the coercive force (iHc), when it is added together with cobalt. Ga can also be added in the Nd-Fe-B magnet of the present invention. Cu in an amount less than 0.01% is also an impurity. Oxygen is incorporated in the Nd-Fe-B sintered magnet during the alloy-pulverizing step, the post-pulverizing, pressing step, and the sintering step. In addition, a large amount of Ca is incorporated in the Nd-Fe-B magnet as a residue of the leaching step (rinsing step for separating CaO) of the co-reducing method for directly obtaining the alloy powder of Nd-Fe-B alloy by reduction with the use of Ca. Oxygen is incorporated in the Nd-Fe-B magnet in an amount of 10,000 ppm (weight ratio) at the maximum. Such oxygen improves neither magnetic properties nor the other properties.

Into the Nd-Fe-B magnet are incorporated carbon from the raw materials of for rare-earth and Fe-B, as well as carbon, phosphorus and sulfur from the lubricant used in the pressing step. Under the present technique, carbon is incorporated in the Nd-Fe-B magnet in an amount of 5,000 ppm (weight ratio) at the maximum. Also, this carbon improves neither the magnetic properties nor the other properties.

A high coercive force (iHc) is obtained by means of heat treating the above inventive Nd-Fe-B magnet in the temperature range of from 500° to 1000° C., as follows.

TABLE 1

| | Composition (at %) | | | | | | | | | iHc (max) | Range of Heat Treatment (°C.) |
|---|---|---|---|---|---|---|---|---|---|---|---|
| Nos. | Nd | Pr | Dy | V | Al | B | Co | M | Fe | kOe | min–max |
| 1 | 16 | — | — | 4 | 0.5 | 8 | — | — | bal | 17.3 | 670–680 |
| 2 | 16 | — | 0.5 | 4 | 0.5 | 8 | — | — | bal | 18.6 | 670 |
| 3 | 16 | 1.5 | — | 3 | 0.7 | 9 | — | — | bal | 17.5 | 650–660 |
| 4 | 16 | — | — | 4 | 1.2 | 8 | 4 | — | bal | 16.9 | 600 |
| 5 | 15 | — | — | 3 | — | 8 | — | Cr = 1 | bal | 16.5 | 640–650 |
| 6 | 15 | — | — | 3 | — | 8 | — | Mo = 1 | bal | 16.8 | 650–660 |
| 7 | 15 | — | — | 3 | — | 8 | — | W = 1 | bal | 16.5 | 650–660 |
| 8 | 15 | — | — | 4 | — | 8 | — | Hf = 1 | bal | 16.9 | 640 |

In this table, the range of heat treatment indicates the temperature range, in which the coercive force (iHc) lower than the maximum coercive force (iHc) by 1 kOe is obtained. If not specified, aluminum is contained as an impurity.

CORROSION RESISTANCE

According to the present invention, all, or almost all, of the B rich phase, which has the lowest corrosion resistance, is replaced with V-Fe-B phase, thereby enhancing the corrosion resistance against water. V forms with B a very stable compound and suppresses the formation of $Nd_1Fe_4B_4$. The corrosion resistance of V-T-B compound is higher than the B rich phase and even higher than both the main phase and Nd-rich phase. The corrosion resistance of Nd-Fe-B magnet according to the present invention is twice as high as the conventional one, when evaluated in terms of weight increase by oxidation under a high-temperature and high-humidity condition of 80° C. and 80% of RH (test for 120 hours). That is, the weight increase of the inventive magnet is half of the conventional magnet. Since the corrosion resistance is improved as described above, it appears that problems of rust, which occur heretofore when magnets are used in appliances, can be drastically lessened.

ADVANTAGES

When Fe of the standard composition $Nd_{15}Fe_{77}B_5$ is replaced with 3.5 at % of V, the coercive force (iHc) is 15 kOe or more. This value is higher than 12 kOe of the coercive force (iHc) of the heat-treated standard composition by 3 kOe. In addition, as is described in the examples hereinbelow, 18 kOe of the coercive force (iHc) is obtained. The enhancement of coercive force (iHc) by the same comparison is 6 kOe and hence is extremely high.

Such enhancement of the coercive force can be explained from the following four points of view.

(1) Effective utilization of R

Since the B rich phase is replaced with the V-Fe-B compound-phase, in which virtually no Nd is solid-dissolved, Nd is relieved from the B rich phase and is utilized for liquid-phase sintering and for forming the main phase. As a result, the coercive force (iHc) is enhanced.

(2) Control of grain-diameter

Specifically speaking, the powder of main phase, in which the $R_2Fe_{14}B$ compound-phase particles have an average diameter of 1 to 5 μm, is liquid-phase sintered, until the average diameter falls within a range of 5 to 15 μm.

Figure 4:
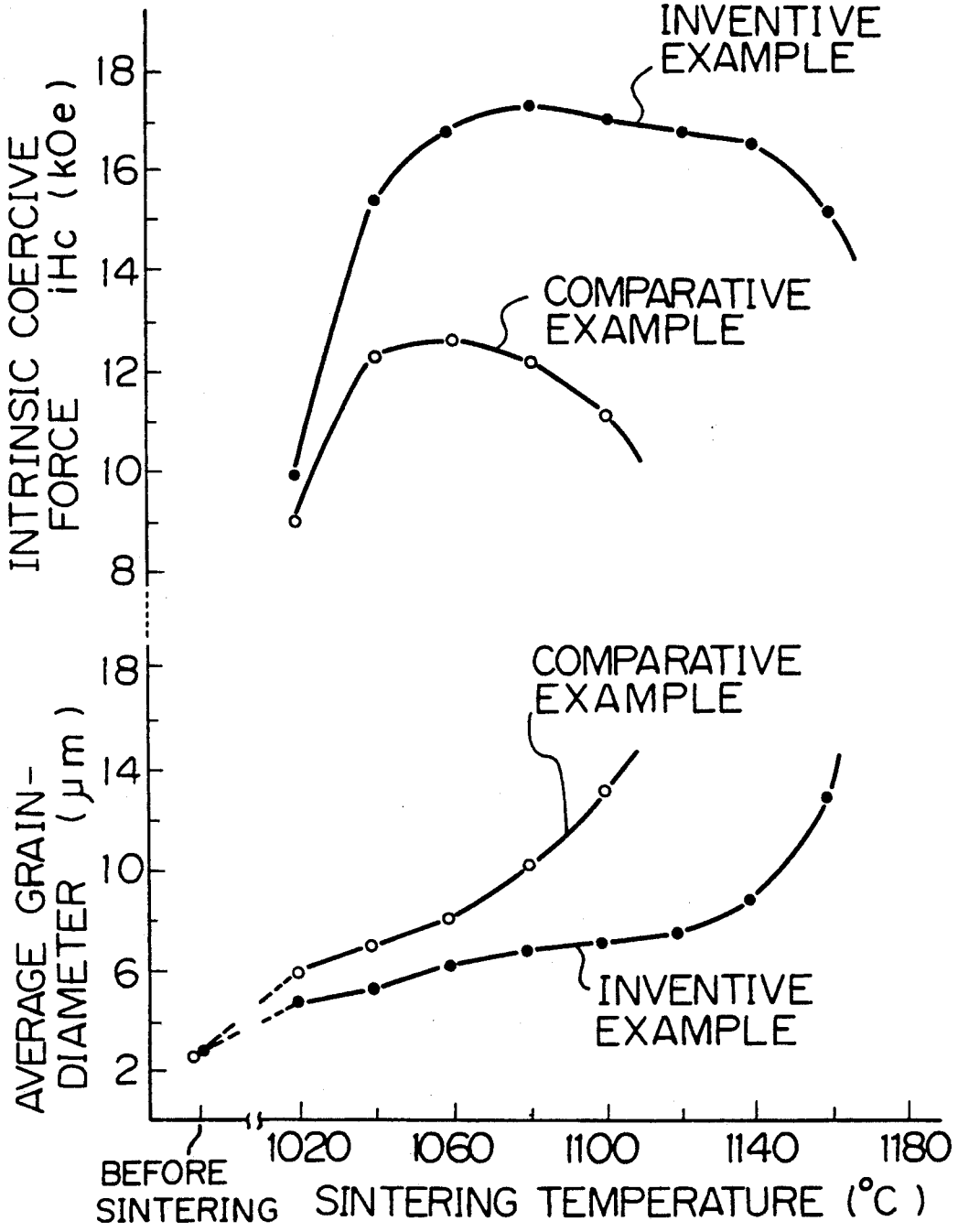
FIG. 4 is a graph showing influence of presence of V-Fe-B compound upon the coercive force (iHc) and grain size.

FIG. 4 graphically illustrates dependence of the coercive force (iHc) and average particle-diameter of $R_2Fe_{14}B$ compound-phase upon the sintering temperature, with regard to the inventive composition of Example 4, in which 6 wt % of V-Fe-B compound is added, and the comparative composition without the addition. The sintering time is 4 hours. When the sintering temperature is such that the average grain-diameter is in the range of from 5 to 15 μm, the coercive force (iHc) is 13 kOe or less in the comparative case but is more than 15 kOe and hence high in the inventive case.

(3) Control of sintering temperature

Specifically speaking, sintering is carried out at $T_2$ and the sintering temperature is suppressed by 10° C. in terms of the temperature (T), given below.

$\Delta T$ is $T_2 - T_1$.

$T_1$ is sintering temperature, at which the average grain-diameter ($d_1$) is obtained under the absence of V-T-B compound.

$T_2$ is sintering temperature, at which the average grain-diameter ($d_2 = d_1$) is obtained under the pressure of V-T-B compound. T therefore indicates temperature which reflects the effects for suppressing the grain growth. The following table shows $T_1$, $T_2$ and $\Delta T$ obtained from FIG. 4.

TABLE 2

| Average Grain-Diameter of Sintered Body ($d_1$, $d_2$, μm) | Suppressing Effects of Grain Growth (ΔT, °C.) | Sintering Temperature (T °C.) |
|---|---|---|
| 6 | 40 | 1060 |
| 7 | 45 | 1090 |
| 8 | 50 | 1130 |
| 9 | 53 | 1140 |
| 10 | 52 | 1145 |
| 12 | 50 | 1160 |

As shown in Table 2, the sintering temperature ($T_2$) can be elevated by 40° C. or more ($T_2 \geqq 40°$ C.) over the sintering temperature $T_1$, while keeping the average-grain diameters equal ($d_1 = d_2$).

(4) Modification of grain-boundaries

It is known in the Nd-Fe-B magnet that the coercive force is closely related with the micro structure of the grain boundaries. Presumably, the V-Fe-B compound functions in the inventive magnet to modify the grain boundaries. When Nd-Fe-Mo-B or Nd-Fe-Cr-B is used instead of V-Fe-B, improvement is not attained at all. This fact suggests that a function of V-Fe-B compound other than the suppression of grain growth is important. The inventive magnet is fundamentally different from the conventional sintered Nd-Fe-B series magnet in the morphology of minority phases, that is, $RFe_4B_4$ phase is present in the latter magnet but is essentially not present in the former magent. It appears in the light of the nature and morphology of minority phases that V-Fe-B compound phase is more appropriate as the phase around the $R_2Fe_{14}B$ compound-phase (main phase) than the $RFe_4B_4$ phase for obtaining a high coercive force. Because of addition of V, the grain boundaries are presumably modified such that nuclei for inversion of the magnetization are difficult to generate.

Incidentally, the maximum energy product of Nd-Fe-B magnet according to the present invention is 20 MGOe or more. This value is the minimum one required for rare-earth magnets having a high-performance. Under this value, the rare-earth magnets cannot compete with the other magnets.

The present invention is hereinafter described with reference to the examples.

EXAMPLE 1

Alloys were melted in a high-frequency induction furnace and cast in an iron mold. As the starting materials the following materials were used: for Fe an electrolytic iron having purity of 99.9 wt %; for B a ferroboron alloy and boron having purity of 99 wt %; Pr having purity of 99 wt %; Dy having purity of 99 wt %; for V a ferrovanadium containing 50 wt % of V; and, Al having purity of 99.9 wt %. Melt was stirred thoroughly during melting and casting so as to provide uniform amount of V in the melt. The thickness of ingots was made 10 mm or less and thin, and cooling was carried out quickly, so as to finely disperse the V-Fe-B compound phase in the ingots. The resultant ingots were pulverized by a stamp mill to 35 mesh. A fine pulverizing was then carried out by a jet mill with the use of nitrogen gas. As a result, the powder having grain diameter of 2.5–3.5 μm was obtained. This powder was shaped under the pressure of 1.5 kg/cm$^2$ and in the magnetic field of 10 kOe.

After the treatment of powder by a jet mill, the powder was thoroughly stirred so as to uniformly and finely disperse the V-Fe-B compound in the sintered body.

The green compact obtained by the pressing under magnetic field was then sintered at 1050° to 1120° C. for 1 to 5 hours in argon atmosphere. The sintered body was heat-treated at 800° C. for 1 hour, followed by rapid cooling by blowing argon gas. Heat treatment was subsequently carried out at 600°–700° C. for 1 hour, followed by rapid cooling by blowing argon gas.

The compositions and magnetic properties of samples are shown in Table 3. When the B content is 8 at % and V-addition amount is 2.7 at %, the V-T-B phase is 90% relative to the total of V-T-B phase and B rich phase. When V-addition amount exceeds 3 at %, V-T-B phase is nearly 100%. However, also in this case, fine $RFe_4B_4$ phase is partly seen due to compositional non-uniformity and the like. The average value (area percentage) of EPMA was converted to volume, which is the percentage of phase mentioned above.

TABLE 3

| | Composition (at %) | | | | | | | Coercive Force iHc (kOe) | | | (BH) max |
|---|---|---|---|---|---|---|---|---|---|---|---|
| No. | Nd | Pr/La | Dy | V | Al | B | Fe | RT | 140° C. | 200° C. | MGOe |
| 1 | 16 | — | — | 4 | 0.5 | 8 | bal | 17.3 | 6.5 | — | 31.1 |
| 2* | 16 | — | — | — | 0.5 | 8 | bal | 13 | 3.5 | — | 34.2 |
| 3* | 14.4 | — | 1.6 | — | 0.6 | 8 | bal | 17.2 | 6.3 | — | 29.8 |
| 4 | 14.4 | — | 1.6 | 4 | 0.6 | 8 | bal | ≧21 | 9.9 | 5.5 | 27.3 |
| 5* | 12.5 | — | 3.5 | — | 0.6 | 8 | bal | ≧21 | 8 | 3.5 | 27.2 |
| 6 | 16 | 1.5 | — | 3 | 0.7 | 9 | bal | 17.5 | 6.2 | — | 30.3 |
| 7 | 14 | 0.5 | — | 4 | 0.6 | 9 | bal | 17.7 | 6.3 | — | 30.9 |
| 8 | 10 | 6 | — | 4 | 0.6 | 8 | bal | 18.1 | 6.5 | — | 30.8 |
| 9* | 16 | — | — | 5 | 1.0 | 5.5 | bal | 13 | 4 | — | 15.7 |
| 10 | 16 | — | — | 6 | 0.9 | 10 | bal | 16.5 | 5.2 | — | 23.8 |
| 11 | 16 | 1.0 | — | 4.8 | 1.1 | 9 | bal | 17.1 | 5.7 | — | 25.9 |
| 12* | 15 | 1.0 | — | 1.5 | 0.6 | 8 | bal | 14.2 | 4.4 | — | 33.1 |
| 13 | 16 | La0.5 | — | 4 | — | 10 | bal | 15.2 | 4.5 | — | 29.1 |
| 14 | 15 | 2 | — | 3.8 | — | 9 | bal | 16.0 | 5.1 | — | 30.1 |
| 15 | 15 | 1 | — | 3 | 2.3 | 8 | bal | 17.5 | 5.8 | — | 28.1 |
| 16 | 14 | 1 | 1.0 | 4.2 | 1.1 | 8 | bal | ≧21 | 8.8 | 4.5 | 27.5 |
| 17 | 12.8 | 0.5 | 2.5 | 3.9 | 0.7 | 9 | bal | ≧21 | 12.2 | 7.2 | 26.2 |
| 18 | 13.7 | 2.5 | 3.0 | 3.7 | 1.0 | 8 | bal | ≧21 | 14.0 | 7.5 | 25.6 |
| 19 | 10.7 | 0.5 | 2.0 | 4 | 1.2 | 9 | bal | ≧21 | 9.1 | 5.5 | 29.3 |
| 20 | 13 | 1.5 | 1.5 | 3.5 | 0.9 | 9 | bal | ≧21 | 9.8 | 5.3 | 26.6 |
| 21 | 12 | — | 4 | 4 | 0.9 | 8 | bal | ≧21 | 15.3 | 9.7 | 22.6 |
| 22 | 16 | — | — | 4 | — | 10 | bal | 16.1 | 5.6 | — | 28.5 |
| 23 | 14.5 | — | 1.5 | 4 | — | 10 | bal | ≧21 | 9.1 | 5.1 | 24.2 |

TABLE 3-continued

| No. | Composition (at %) Nd | Pr/La | Dy | V | Al | B | Fe | Coercive Force iHc (kOe) RT | 140° C. | 200° C. | (BH) max MGOe |
|---|---|---|---|---|---|---|---|---|---|---|---|
| 24 | 16 | — | — | 4 | 1.2 | 8 | Co = 5 Fe = bal | 16.9 | 5.6 | — | 30.9 |
| 25 | 14.4 | — | 1.6 | 4 | 1.5 | 9 | Co = 9 Fe = bal | ≧21 | 8.3 | 5.0 | 25.3 |
| 26 | 11.7 | — | — | 5.3 | 1.3 | 9.8 | bal | 16.1 | 5.4 | — | 29.0 |
| 27* | 9 | — | — | 5 | 1.2 | 10.1 | bal | 1.5 | — | — | — |
| 28 | 16 | — | — | 6 | 0.9 | 11 | bal | 16.2 | 5.3 | — | 23.5 |
| 29 | 11.5 | — | 1.5 | 6 | 1.0 | 10.3 | bal | ≧21 | 8.3 | 5.0 | 29.5 |

Remarks: The asterisked samples are comparative. The samples without asterisk are inventive. Samples Nos. 13, 14, 22, and 23 indicate 0.4% by weight or less of Al as an impurity.

EXAMPLE 2

Figure 5:
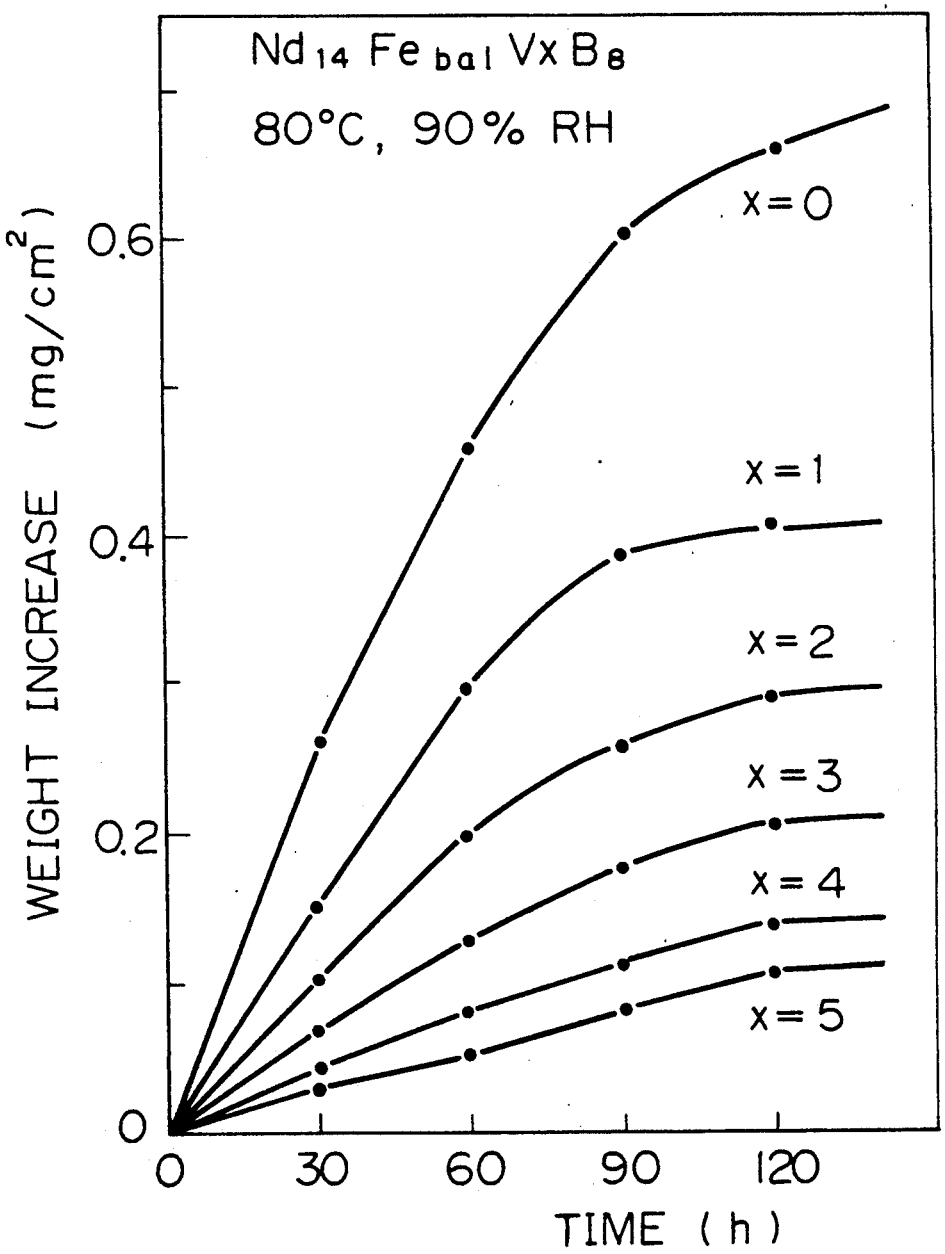
FIG. 5 is a graph illustrating the corrosion resistance of Nd-Fe-B sintered magnet.

Sheets 10×10×1 mm in size, consisting of $Nd_{14}Fe_{bal}B_8V_x$ were prepared by the same method as Example 1. These sheets were heated at 80° C. in air having 90% of RH up to 120 hours, and the weight increase by oxidation was measured. The results are shown in FIG. 5. It is apparent from FIG. 5 that the corrosion resistance is considerably improved by the addition of V.

EXAMPLE 3

The weight increase by oxidation was measured by the same method as in Example 2 for the compositions given in Table 5. The results are shown in Table 4.

In the following Examples the composition is $Nd_{16}Fe_{72}V_4B_8$ or $(Nd_{0.9}Dy_{0.1})_{16}Fe_{72}V_4B_8$.

EXAMPLE 4

A: $Nd_{10}Fe_{86}B_4$, B: $Nd_{30}Fe_{66}B_4$, and C: $(V_{0.6}Fe_{0.4})_3B_2$ were melted in a high-frequency induction furnace, and ingots were formed. The ingots were pulverized by a jaw crusher and a disc mill to obtain powder through 35 mesh. A and B were then pulverized by a ball mill to an average particle diameter of 3 μm. C was pulverized by a ball mill to an average particle diameter of 1 μm. At this step, the powder A consisted of particles of $Nd_2Fe_{14}B$, $Fe_2B$, and α-Fe. The powder B consisted of particles of $Nd_2Fe_{14}B$, $Nd_2Fe_{17}$, and Nd-rich phase. Almost all of the powder of C was the single-phase

TABLE 4

| No. | Composition (at %) Nd | R | Dy | V | Al | B | Co | M | Weight Increase by Oxidation (Δw) (mg/cm²) | iHc (kOe) | Proportion of V-T-B |
|---|---|---|---|---|---|---|---|---|---|---|---|
| 1* | 15 | — | — | — | — | 8 | — | — | 0.68 | 12.5 | 0 |
| 2 | 15 | — | — | 2.7 | — | 8 | — | — | 0.29 | 15.5 | 90 |
| 3 | 15 | — | — | 4 | — | 8 | — | — | 0.12 | 17.0 | ~100 |
| 4 | 15 | — | — | 6 | — | 9 | — | — | 0.06 | 16.5 | ~100 |
| 5 | 13 | — | — | 6 | — | 10 | — | — | 0.08 | 16.3 | ~100 |
| 6 | 11 | Pr = 2 | — | 6 | — | 10 | — | — | 0.09 | 16.8 | ~100 |
| 7 | 13.5 | — | 1.5 | 4 | — | 8 | — | — | 0.11 | ≧21 | ~100 |
| 8 | 14 | Ce = 1 | — | 4 | — | 8 | — | — | 0.12 | 16.2 | ~100 |
| 9 | 15 | — | — | 4 | 2 | 8 | — | — | 0.12 | 18.0 | ~100 |
| 10 | 15 | — | — | 4 | — | 8 | 6 | — | 0.10 | 16.8 | ~100 |
| 11 | 15 | — | — | 4 | — | 8 | 16 | — | 0.08 | 15.8 | ~100 |
| 12 | 15 | — | — | 3 | — | 8 | — | Cr = 0.5 | 0.14 | 16.4 | 95 |
| 13 | 15 | — | — | 3 | — | 8 | — | Cr = 1 | 0.13 | 16.5 | 95 |
| 14 | 15 | — | — | 2 | — | 8 | — | Cr = 2 | 0.12 | 16.9 | 95 |
| 15 | 13.5 | — | 1.5 | 3 | — | 8 | — | Cr = 1 | 0.12 | ≧21 | 95 |
| 16 | 15 | — | — | 3 | — | 8 | — | Mo = 1 | 0.13 | 16.6 | ~100 |
| 17 | 15 | — | — | 2 | — | 8 | — | Mo = 2 | 0.14 | 16.7 | 95 |
| 18 | 15 | — | — | 1 | — | 8 | — | Mo = 3 | 0.14 | 16.5 | 90 |
| 19 | 13.5 | — | 1.5 | 2 | — | 8 | — | Mo = 2 | 0.15 | ≧21 | 95 |
| 20 | 15 | — | — | 3 | — | 8 | — | W = 1 | 0.18 | 16.5 | ~100 |
| 21 | 15 | — | — | 3 | — | 8 | — | Nb = 1 | 0.14 | 16.2 | 95 |
| 22 | 15 | — | — | 3 | — | 8 | — | Ta = 1 | 0.13 | 16.2 | 95 |
| 23 | 15 | — | — | 3.5 | — | 8 | — | Ni = 1 | 0.10 | 16.7 | 100 |
| 24 | 15 | — | — | 3.5 | — | 8 | — | Ti = 0.5 | 0.15 | 16.6 | 100 |
| 25 | 15 | — | — | 4 | — | 8 | — | Zr = 0.5 | 0.16 | 16.5 | 100 |
| 26 | 15 | — | — | 4 | 2 | 8 | — | — | 0.10 | 18.0 | ~100 |
| 27 | 13.5 | — | 1.5 | 4 | 2.5 | 8 | — | — | 0.08 | ≧21 | ~100 |
| 28 | 15 | — | — | 4 | — | 8 | — | Hf = 0.5 | 0.16 | 16.9 | ~100 |
| 29 | 15 | — | — | 3.5 | — | 8 | — | Si = 0.5 | 0.15 | 16.3 | ~100 |
| 30 | 15 | — | — | 3.5 | — | 8 | — | — | 0.17 | 16.4 | ~100 |
| 31 | 15 | — | — | 4 | — | 8 | — | Mn = 0.5 | 0.18 | 16.2 | ~100 |
| 32 | 15 | — | — | 4 | — | 8 | 5 | — | 0.10 | 16.7 | ~100 |
| 33 | 15 | — | — | 4 | — | 8 | 10 | — | 0.09 | 16.6 | ~100 |
| 34 | 15 | — | — | 4 | — | 8 | 15 | — | 0.08 | 16.4 | ~100 |
| 35* | 15 | — | — | 0.5 | — | 8 | — | — | 0.60 | 13.5 | ~20 |
| 36* | 15 | — | — | 7 | — | 8 | — | — | 0,09 | 13.2 | ~100 |

Remarks: The asterisked samples are comparative. The samples, whose Al content is not specified, contain 0.4 wt % of Al. Sample No. 30 contains 0.5 at % Ga as an impurity. The balance component is Fe.

$(V_{0.6}Fe_{0.4})_3B_2$ powder. The A, B, and C powders were blended in weight ratio of 51:43:6 and then mixed for 3 hours by a rocking mixer. The mixed powder was pressed at a pressure of 1 t/cm$^2$ in a magnetic field of 12 kOe, and then sintered at 1100° C. for 4 hours in the Ar with pressure of $10^{-2}$ torr. After sintering, rapid cooling was carried out. Heat treatment was then carried out at 670° C. for 1 hour. The magnetic properties were as follows.

The residual magnetization Br=11.6 kG.

The coercive force (iHc)=18.4 kOe.

The maximum energy product (BH)max=31.3 MGOe.

The average particle-diameter of the sintered body was 5.9 μm. The B rich phase was inappreciable by measurement of the sintered body by EPMA.

EXAMPLE 5

A: $Nd_{18}Fe_{77}B_4$ and B: $(V_{0.6}Fe_{0.4})_3B_2$ were pulverized by the same methods as in Example 4 to 3.7 μm and 1.5 μm, respectively. At this step, the powder A consisted of particles of the $Nd_2Fe_{14}B$, Nd rich phase and $Nd_2Fe_{17}$ phase, and the powder B consisted of the particles of single $(V_{0.6}Fe_{0.4})_3B_2$ phase. Mixing by a rocking mixer was carried out for 1 hour to provide the weight proportion of A:B=94:6. A sintered magnet was produced under the same conditions as in Example 4. The magnetic properties were as follows.

The residual magnetization Br=11.7 kG.

The coercive force (iHc)=17.9 kOe.

The maximum energy product (BH)max=31.7 MGOe.

The average particle-diameter of the sintered body was 6.1 μm. The B rich phase was inappreciable by measurement of the sintered body by EPMA.

EXAMPLE 6

An $Nd_{16}Fe_{72}V_4B_8$ alloy was pulverized by a jet mill with the use of nitrogen gas to 2.5 μm in average. At this step, powder consisted of particles of the respective single $Nd_2Fe_{14}B$, Nd rich alloy, and V-Fe-B phases. The dispersion state of particles of V-Fe-B compound were however not uniform. After the pulverizing, the crushing by a rocking mixer was carried out for 2 hours. A sintered magnet was produced under the same conditions as in Example 4.

The magnetic properties were as follows.

The residual magnetization Br=11.6 kG.

The coercive force (iHc)=17.3 kOe.

The maximum energy product (BH)max=31.7 MGOe.

The average particle-diameter of the sintered body was 6.8 μm. The B rich phase was inappreciable by measurement of the sintered body by EPMA.

EXAMPLE 7

A: $Nd_{16}Fe_{80}B_4$ and B: $Nd_{16}Fe_{70}V_5B_9$ were pulverized by a jet mill and a ball mill to 2.8 μm and 1.9 μm, respectively. At this step, the powder A consisted of particles of the $Nd_2Fe_{14}B$, Nd rich phase and $Nd_2Fe_{17}$ phase, and the powder B consisted of the particles of $Nd_2Fe_{14}B$ phase, Nd rich phase, V-Fe-B compound, and $Nd_2Fe_{17}$ phase. Mixing by a rocking mixer was carried out for 2 hours to provide the weight proportion of A:B=6:94. A sintered magnet was produced under the same conditions as in Example 4. The magnetic properties were as follows.

The residual magnetization Br=11.5 kG.

The coercive force (iHc)=17.6 kOe.

The maximum energy product (BH)max=31.5 MGOe.

The average particle-diameter of the sintered body was 6.3 μm. The B rich phase was inappreciable by measurement of the sintered body by EPMA.

EXAMPLE 8

A: $Nd_{16.4}Dy_{1.8}Fe_{79.5}B_{2.3}$ and B: $V_{33}Fe_{22}B_{45}$ were pulverized by a jet mill and a ball mill to 2.6 μm and 1.5 μm, respectively. At this step, the powder A consisted of particles of the $R_2Fe_{14}B$, R rich phase and $R_2Fe_{17}$ phase, and the powder B consisted of the particles of $(V_{0.6}Fe_{0.4})_3B_2$ and $(V_{0.6}Fe_{0.4})B$ phases. Mixing by a rocking mixer was carried out for 2 hours to provide the mixture having weight proportion of A:B=94:6. A sintered magnet was produced under the same conditions as in Example 3. The magnetic properties were as follows.

The residual magnetization Br=11.0 kG.

The coercive force (iHc)=21 kOe or more.

The maximum energy product (BH)max=28.5 MGOe.

The average particle-diameter of the sintered body was 6.0 μm. The B rich phase was inappreciable by measurement of the sintered body by EPMA.

COMPARATIVE EXAMPLE 1

The same methods as in Example 5 were carried out except that the mixing by a rocking mixer was omitted. The magnetic properties were as follows.

The residual magnetization Br=11.5 kG.

The coercive force (iHc)=12.8 kOe.

The maximum energy product (BH)max=30.7 MGOe.

The particle-diameter of the sintered body greatly dispersed from 10.3 μm at the minimum to 17 μm at the maximum. The B rich phase was locally observed in the sintered body under measurement of EPMA. The amount of B rich phase was 3% in the sintered body as a whole.

I claim:

1. An Nd-Fe-B sintered magnet having a temperature coefficient of coercive force iHc of 0.5%/° C. or greater and consisting essentially of 11 to 18 at % R, where R is one or more rare earth elements except for Dy and the total amount of Nd and Pr is at least 80 at % of the total rare earth elements, 6 to 12 at % B, Fe, impurities, and from 2 to 6 at % V, wherein B in excess of a stoichiometric amount for a $R_2Fe_{14}B$ compound-phase in the sintered magnet is essentially in the form of a finely dispersed V-Fe-B compound minority phase, and the sintered magnet is essentially free of a R $Fe_4B_4$ compound minority phase, the sintered magnet exhibiting a maximum energy product BH(max) of at least 20 MGOe and a coercive force iHc of at least 15 kOe.

2. An Nd-Fe-B sintered magnet according to claim 1, further consisting essentially of up to 3 at % aluminum.

3. An Nd-Fe-B sintered magnet according to claim 1 or 2, wherein the magnet further consists essentially of at least one of $M_1$, $M_2$ and $M_3$, wherein $M_1$ is up to 4 at % of one or more of elements selected from the group consisting of Cr, Mo and W, $M_2$ is up to 3 at % of one or more elements selected from the group consisting of Nb, Ta and Ni, and $M_3$ is up to 2 at % of one or more elements selected from the group consisting of Ti, Zr, Hf, Si and Mn.

4. An Nd-Fe-B sintered magnet according to claim 1 or 2, having a coercive force iHc at 140° C. of at least 5 kOe.

5. An Nd-Fe-B sintered magnet according to claim 1 or 2, having a coercive force iHc at 200° C. of at least 5 kOe.

6. An Nd-Fe-B sintered magnet having a temperature coefficient of coercive force iHc of 0.5%/° C. or greater and consisting essentially of 11 to 18 at % R, where R is one or more rare earth elements, Dy is up to 4 at % of the magnet and the total amount of Nd, Pr and Dy is at least 80 at % of the total rare earth elements; 6 to 12 at % B; Fe, impurities and from 2 to 6 at % V, wherein B in excess of a stoichiometric amount for a $R_2Fe_{14}B$ compound-phase in the sintered magnet is essentially in the form of a finely dispersed V-Fe-B compound minority phase, and the sintered magnet is essentially free of a $RFe_4B_4$ compound minority phase.

the sintered magnet exhibiting a maximum energy product BH(max) of at least 20 MGOe and a coercive force iHc of 15+3x kOe (where x is the amount of Dy in at %).

7. An Nd-Fe-B sintered magnet according to claim 6, further consisting essentially of up to 3 at % aluminum.

8. An Nd-Fe-B sintered magnet according to claim 6 or 7, wherein the magnet further consists essentially of at least one of $M_1$, $M_2$ and $M_3$, wherein $M_1$ is up to 4 at % of one or more of elements selected from the group consisting of Cr, Mo and W, $M_2$ is up to 3 at % of one or more elements selected from the group consisting of Nb, Ta and Ni, and $M_3$ is up to 2 at % of one or more elements selected from the group consisting of Ti, Zr, Hf, Si and Mn.

9. An Nd-Fe-B magnet according to claim 6 or 7, having a coercive force iHc of at least 5+2x kOe at 140° C.

10. An Nd-Fe-B magnet according to claim 6 or 7, having a coercive force iHc of at least 5 kOe at 200° C.

11. An Nd-Fe-B sintered magnet having a temperature coefficient of coercive force iHc of 0.5%/° C. or greater and comprising 11 to 18 at % R, where R is one or more rare earth elements except for Dy and the total amount of Nd and Pr is at least 80 at % of the total rare earth elements, 6 to 12 at % B, Fe, Co in an amount of up to 25 at % of the total Fe and Co which is effective to enhance the Curie temperature of the magnet, impurities, and from 2 to 6 at % V, wherein B in excess of a stoichiometric amount for a $R_2Fe_{14}B$ compound-phase in the sintered magnet is essentially in the form of a finely dispersed V-(Fe,-Co)-B compound minority phase, and the sintered magnet is essentially free of a $RFe_4B_4$ compound minority phase, the sintered magnet exhibiting a maximum energy product BH(max) of at least 20 MGOe and coercive force iHc of at least 15 kOe.

12. An Nd-Fe-B sintered magnet according to claim 11, further consisting essentially of up to 3 at % aluminum.

13. An Nd-Fe-B sintered magnet according to claim 11 or 12, wherein the magnet further consists essentially of at least one of $M_1$, $M_2$ and $M_3$, wherein $M_1$ is up to 4 at % of one or more of elements selected from the group consisting of Cr, Mo and W, $M_2$ is up to 3 at % of one or more elements selected from the group consisting of Nb, Ta and Ni, and $M_3$ is up to 2 at % of one or more elements selected from the group consisting of Ti, Zr, Hf, Si and Mn.

14. An Nd-Fe-B sintered magnet according to claim 11 or 12, having a coercive force iHc at 140° C. of at least 5 kOe.

15. An Nd-Fe-B sintered magnet according to claim 11 or 12, having a coercive force iHc at 200° C. of at least 5 kOe.

16. An Nd-Fe-B sintered magnet having a temperature coefficient of coercive force iHc of 0.5%/° C. or greater and comprising 11 to 18 at % R, where R is one or more rare earth elements, Dy is up to 4 at % of the magnet and the total amount of Nd, Pr and Dy is at least 80 at % of the total rare earth elements; 6 to 12 at % B; Fe, Co in an amount of up to 25 at % of the total Fe and Co which is effective to enhance the Curie temperature of the magnet, impurities and from 2 to 6 at % V, wherein B in excess of a stoichiometric amount for a $R_2Fe_{14}B$ compound-phase in the sintered magnet is essentially in the form of a finely dispersed V-(Fe, Co)-B compound minority phase, and the sintered magnet is essentially free of a $RFe_4B_4$ compound minority phase, the sintered magnet exhibiting a maximum energy product BH(max) of at least 20 MGOe and a coercive force iHc of 15+3x kOe (where x is the amount of Dy in at %).

17. An Nd-Fe-B sintered magnet according to claim 16, further consisting essentially of up to 3 at % aluminum.

18. An Nd-Fe-B sintered magnet according to claim 16 or 17, wherein the magnet further consists essentially of at least one of $M_1$, $M_2$ and $M_3$, wherein $M_1$ is up to 4 at % of one or more of elements selected from the group consisting of Cr, Mo and W, $M_2$ is up to 3 at % of one or more elements selected from the group consisting of Nb, Ta and Ni, and $M_3$ is up to 2 at % of one or more elements selected from the group consisting of Ti, Zr, Hf, Si and Mn.

19. An Nd-Fe-B magnet according to claim 16 or 17, having a coercive force iHc of at least 5+2x kOe at 140° C.

20. An Nd-Fe-B magnet according to claim 16 or 17, having a coercive force iHc of at least 5 kOe at 200° C.

* * * * *